United States Patent [19]

Gomory

[11] 4,435,269

[45] Mar. 6, 1984

[54] CONVERSION OF LIGNITE TO HIGHER QUALITY FUELS

[75] Inventor: Paul L. Gomory, Bethesda, Md.

[73] Assignee: Phillips Petroleum Company, Bartlesville, Okla.

[21] Appl. No.: 373,775

[22] Filed: Apr. 30, 1982

[51] Int. Cl.[3] ..... C10G 1/06; C10G 1/00

[52] U.S. Cl. ..... 208/8 R; 208/8 LE; 208/80

[58] Field of Search ..... 208/8 R, 80, 11 R, 8 LE

[56] References Cited

U.S. PATENT DOCUMENTS

| | | | |
|---|---|---|---|
| 1,904,586 | 4/1933 | Winkler et al. | 208/8 R |
| 2,572,734 | 10/1951 | Kramer | 208/107 |
| 2,676,908 | 4/1954 | Noel | 208/8 R |
| 3,152,063 | 10/1964 | Schroeder et al. | 208/10 |
| 3,228,869 | 1/1966 | Irish | 208/11 R |
| 3,361,644 | 1/1968 | Deering | 208/11 R |
| 3,503,864 | 3/1970 | Nelson | 208/10 |
| 3,519,552 | 7/1970 | Hellwig | 208/8 R |
| 3,565,784 | 2/1971 | Schlinger et al. | 208/11 A |
| 3,594,304 | 7/1971 | Seltzer et al. | 208/8 R |
| 4,010,092 | 3/1977 | Deering | 208/11 R |
| 4,011,058 | 3/1977 | Johnson et al. | 248/197 R |
| 4,028,221 | 6/1977 | Sze et al. | 208/8 R |
| 4,043,897 | 8/1977 | Deering | 208/11 R X |
| 4,075,079 | 2/1978 | Lang | 208/8 LE |
| 4,111,786 | 9/1978 | Sugimura et al. | 208/8 R |
| 4,119,523 | 10/1978 | Baldwin et al. | 208/8 R |
| 4,159,897 | 7/1979 | Doehlert | 208/8 LE X |
| 4,183,733 | 1/1980 | Jäger | 208/8 R X |
| 4,227,991 | 10/1980 | Carr et al. | 208/8 LE |
| 4,230,556 | 10/1980 | Carr et al. | 208/8 LE |
| 4,324,038 | 4/1982 | Durai-Swamy | 208/8 R X |
| 4,334,977 | 6/1982 | Derbyshire et al. | 208/8 LE |

*Primary Examiner*—Delbert E. Gantz
*Assistant Examiner*—Glenn A. Caldarola

[57] ABSTRACT

A process to obtain liquid and gaseous hydrocarbon products from low grade carbonaceous deposits such as lignite, by retorting a first portion to produce a hydrocarbon oil, and reacting a second portion with the oil, thus producing increased fuel oils and gases.

15 Claims, 1 Drawing Figure

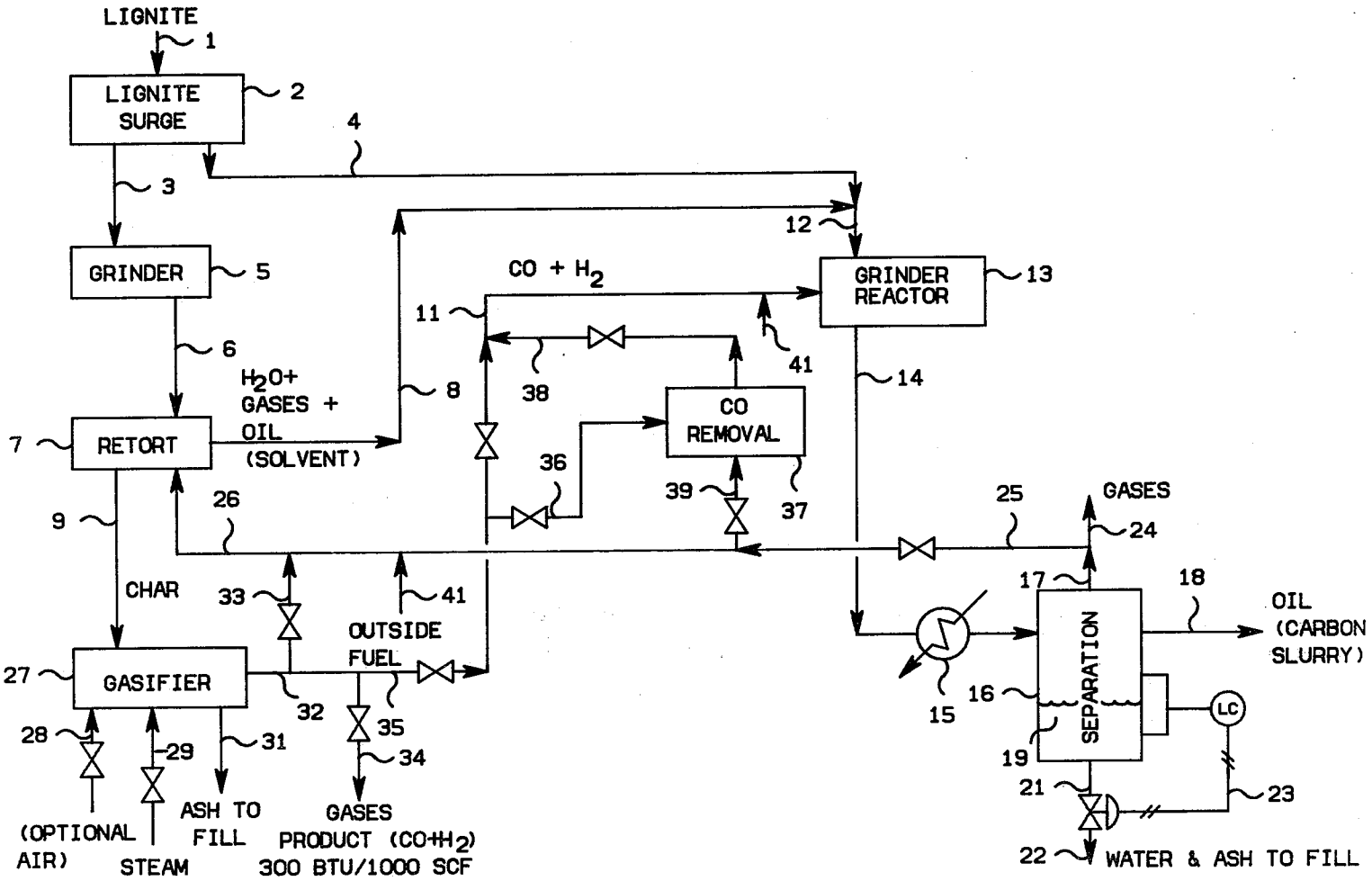
LIGNITE
1
LIGNITE SURGE
2
3
4
GRINDER
5
6
RETORT
7
8
9
$H_2O$+ GASES + OIL (SOLVENT)
CHAR
26
GRINDER REACTOR
13
12
14
CO REMOVAL
37
39
41
38
36
11
$CO + H_2$
GASIFIER
27
28
29
33
32
31
ASH TO FILL
(OPTIONAL AIR)
STEAM
OUTSIDE FUEL
35
34
GASES
PRODUCT ($CO+H_2$)
300 BTU/1000 SCF
SEPARATION
15
16
17
18
19
21
22
23
LC
OIL (CARBON SLURRY)
GASES
24
25
WATER & ASH TO FILL

CONVERSION OF LIGNITE TO HIGHER QUALITY FUELS

The invention pertains to the conversion of low grade carbonaceous solid materials to more useful fuels including oils and gases. In another aspect, this invention pertains to an on-site beneficiation process for low grade carbonaceous materials.

BACKGROUND OF THE INVENTION

Vast amounts of low grade carbonaceous deposits such as lignites and peats exist in the United States, and elsewhere. Peat is considered the lowest grade, essentially the first stage in the development of coal from vegetable matter. Lignites tend to disintegrate when exposed to water, and generally contain such high moisture and ash contents that mining, shipping, storage, and preparation for fuel usages tend to make them uneconomic materials. However, the literally trillions of tons of lignitic material available in the United States, usually fairly close to the surface so that strip-mining is feasible and practical, present an attractive resource of carbon, providing adequate methods can be developed for converting the carbon into more useful and transportable higher quality fuels, both liquids and gases, which can be utilizable in existing fuel burning equipment or refining processes.

BRIEF SUMMARY OF THE INVENTION

In have discovered a method to beneficiate low grade solid carbonaceous deposits of peat and lignite. In accordance with my process, low grade carbonaceous materials are converted to higher quality fuels. My invention is particularly useful for on-site beneficiation operations.

While hereinafter I use lignite as exemplary basis to describe my invention, it is to be understood that my invention is applicable to any low grade solid carbonaceous material such as peat or lignite.

My invention in one aspect involves a process for the beneficiation of a low grade carbonaceous fuel source, which comprises: retorting a first portion of said fuel source under retort conditions of elevated temperatures effective to convert said first portion to char, and materials comprising a first stream of hydrocarbon gases and a first oil; and contacting a second portion of said fuel source with at least a portion of said first oil, optionally further with said first hydrocarbon gases, under reaction conditions of elevated temperatures, thereby converting at least in part the carbonaceous content of said second portion to a second oil stream.

A first portion of lignite, after being ground, is retorted at elevated temperatures to produce a first stream of gaseous and liquid hydrocarbon products, and char. A second portion of lignite is treated in a heated, optionally pressurized, grinder-reactor zone in contact with liquid hydrocarbons recovered from the retorting step to effect reactions between the hydrocarbons and the freshly ground second portion of lignite. Hot gases from the retorting zone may also be introduced into the grinder-reactor to supply heat and to participate in the reactions therein. The char is used for gasification with steam to produce hydrogen useful in the reactor. Effluent from the grinder-reactor is partially condensed to yield a second stream of gaseous and liquid hydrocarbons, solid carbonaceous residue, and water and ash products. The carbonaceous residues can be slurried in the liquid hydrocarbons to yield a fuel with improved burning qualities. Water and ash are separated and removed for disposal.

BRIEF DESCRIPTION OF THE DRAWING

Lignite 1 is fed 3 to a grinder 5. The ground lignite 6 is retorted 7 to produce gases, oily hydrocarbonaceous solvents, and char. The char 9 is utilized in a gasifier 27 to produce carbon monoxide and hydrogen 32 for fuel usages in the system. A further portion of lignite is fed 4 to a grinder-reactor 13 wherein the lignite is reacted in the presence of some of the oily solvent from the retort and with carbon monoxide and hydrogen from the gasifier as heat source, to produce a product stream 14 which then is separated 16 to produce gases 24 for transport, and oil 18 as product.

DETAILED DESCRIPTION OF THE PROCESS

In accordance with my benefication process, a first portion of lignite (or peat) is retorted under retorting conditions of elevated temperatures to produce a first stream of gaseous and liquid hydrocarbon products, and char. A second portion of lignite is ground in a heated, optionally pressurized reaction zone in contact with a portion of the liquid hydrocarbons recovered from the retorting step to effect reactions between the hydrocarbons and the freshly ground lignite. Hot gases from the retorting zone also can be introduced into the grinder-reactor to supply heat and to participate in the reactions therein. Char can be reacted with steam to produce a conversion gas stream of CO and hydrogen useful in the grinder-reactor step, or elsewhere as fuel. Hot gaseous effluent from the grinder-reactor is partially condensed to yield a second stream of gaseous and liquid hydrocarbons, carbonaceous residues, and water and ash products. The carbonaceous solids can be slurried in the liquid hydrocarbon to yield a fuel with improved burning qualities. Water and ash are separately removed for disposal.

The process of my invention can be more fully understood by referring to the attached drawing and the detailed discussion pertaining thereto. Lignite is employed as exemplary of a low grade carbonaceous source, such as peat or lignite, or even brown coal, since the distinctions between these are not necessarily precise. All of such low grade carbonaceous materials need beneficiation, upgrading, to provide more valuable fuels. In my drawing and discussion I use lignite as typical, since it represents the largest known deposits of carbon-in-place in the United States, and potentially represents the most usable source, being available in convenient areas suitable for large scale strip mining operations, and even on-site processing. Lignites contain about 20–45 percent moisture, and have heating values of such as 5500–8300 Btu per pound.

Lignite 1, obtained such as a strip-mining operation, is directly provided in rough broken form to a lignite surge supply 2. As needed, the lignite is drawn 3 for reduction in particle size 5 to such as a U.S. standard mesh of about −40. The grinding operation can be conducted by any suitable pulverizing equipment capable of handling a high ash containing high mosture containing solid carbonaceous material, such as the Raymond Roller Mill as described in *Textbook of Ore Dressing Third Edition* (1940 McGraw Hill Book Co., Inc.), Robert H. Richards, et al. pp. 83–84.

A first portion of ground lignite 6 is conveyed to retort or coker 7, wherein the ground lignite is heated at elevated temperatures of such as about 800° to 1400° F., preferably at elevated pressures, utilizing a system generated fuel gas 26 as heat source, to produce in the retorting operation an off stream 8 comprising water, gases, and hydrocarbon oils. The residual material which not volatilized is removed 9 as char.

Char 9 comprises a high carbon content solid material which is conveyed to gasifier 27. In gasifier 27 the carbon of the char is converted with steam 29 to a highly useful fuel gas stream 32 of carbon monoxide and hydrogen. This reaction is basically the water gas reaction such as is described in Kirk-Othmer *Encyclopedia of Chemical Technology* Vol. 8, (Interscience 1952) pp. 72–78. If desired, gasifier 27 further can employ optional air 28 in such proportion as is necessary to maintain adequate high temperatures for the char water gas reaction by burning a portion of the carbon contained therein, if the char 9 from retort 7 is not at sufficient temperature to effect the water-gas reaction. Residual ash is removed at 31 to waste disposal.

A second portion of lignite 4 from surge 2 is conveyed 12 to grinder-reactor 13. Grinder-reactor 13 reacts the ground lignite at elevated temperatures and suitable pressures with a portion of the hydrocarbon oils 8 from retort 7, and further desirably employs carbon monoxide and hydrogen 35, 41, from gasifier 27. In grinder-reactor 13 are conducted reactions between the hydrocarbons and the ground lignite, employing the foresaid gases from the gasifier in order to provide heat and as well to participate in the involved reaction in the grinder-reactor. The grinder-reactor can be any type of suitable liquid solid gaseous intimate contacting system suitable, such as described in U.S. Pat. Nos. 3,519,552 or 3,503,864.

Effluent 14 from grinder-reactor is conveyed, with cooling 15 if necessary, to separation 16. Liquid-vapor separation is employed, taking off-gases overhead 17 to provide a supply of hydrocarbon gases 24 for shipment, as well as to furnish an optional supply 25, 26 for internal usage as fuel in the retort step 7. Some of the gases 17 may be taken, as desired, 39 to carbon monoxide separation 37, and the CO-free or depleted stream 38 recycled as a high hydrogen content gas 11 to grinder-reactor 13. Outside fuel or hydrogen-rich gas can be charged via 41, if needed.

It is theorized that hydrogen is transferred from the liquid hydrocarbons 8 to the ground lignite in grinder-reactor 13, thereby aiding in the conversion of at least part of the lignite into further liquid hydrocarbons. Since the liquid hydrocarbons so employed may become reduced in hydrogen content, it frequently is desirable to add hydrogen-containing gases, such as produced in gasifier 27. By augementing the content of hydrogen by removing some carbon monoxide 37, further improved reactions in the grinder-reactor can be obtained. Thus, if desired, some of the off gas 32, 35 from gasifier 27, can be taken 36, to carbon monoxide removal 37 and then the hydrogen-enriched gas taken 38, 11 to grinder reactor 13. Of course, depending on the amount of char 9 produced from retort 7, gasifier 27 may at times produce larger than necessary quantities of hydrocarbon gas 32, and while this gaseous product 32 is utilizable 33 in retort 7 as and when needed, some of the gaseous product when surplus can be taken 34 to other plant usages or even for pipeline sale as fuel.

From separation 16 is obtained an oil 18 as a primary product. This hydrocarbon oil has many usages as such, since it has a high Btu content of such as about 18000 Btu per pound. The oil is particularly useful since the oil will normally contain a particulate carbon in slurry form, such as about 5 weight percent. As such, this oil is a highly valuable carbon black feedstock with a high BMCI value. In operation of separation 16 it usually will be desirable to maintain a liquid level 19 by liquid level control system 23. Water and ash can be removed 21, 22, for waste disposal.

Carbon monoxide removal step 37, where desired to be applied to either gaseous stream 25 from separation 16, or to gaseous stream 35 from gasifier 27, or both, is readily accomplished by known carbon monoxide removal processes such as described in U.S. Pat. No. 2,572,734.

The following calculated example is intended to assist one skilled in the art to a further understanding of my invention. Particular balances shown, as well as suggested operating conditions, can be adjusted by one skilled in the art in accordance with a particular low grade carbonaceous fuel employed, since, it is known, such fuels do vary widely in type and quality, varying in ash content, water content, and the like. The example is set forth without employing various recycle streams, since these can be readily proportioned by one skilled in the art depending on variation in the operating conditions.

| | Calculated Example (With No Recycles) | | |
|---|---|---|---|
| (1) Lignite, Pounds/Hr, | | 2000 | |
| Composition, Wt. %, | | | |
| Carbon | 48 | | |
| Hydrogen | 2 | | |
| Water | 30 | | |
| Ash (Clay) | 20 | | |
| | 100 | | |
| (3) Lignite to Grinder 5, Pounds/Hr, | | 1000 | |
| (6) Lignite to Retort 7, Pounds/Hr, | | 1000 | |
| (9) Char plus Ash, Pounds/Hr, | | 440 | (About 54% by wt. carbon) |
| (8) Water & Hydrocarbonaceous product to reactor 13, Pounds/Hr, | | 560 | (About 54% by wt. $H_2O$) |
| (29) Steam to Gasifier 27, Pounds/Hr, | | 360 | |
| (31) Ash, Pounds/Hr, | | 200 | |
| (35) Gas Yield, Pounds/Hr, | | 600 | (To Reactor 13) |
| Composition, Vol. % | | | |

-continued

| | Calculated Example (With No Recycles) | | |
|---|---|---|---|
| Hydrogen | 6.7 | | |
| Carbon monoxide | 93.3 | | |
| (4) Lignite to 13, Pounds/Hr, | | 1000 | |
| (14) Yield from 13, Pounds/Hr, | | 2160 | |
| (17) Gas Yield, Pounds/Hr, | | 560 | (CO and Light Hydrocarbons) |
| (18) Liquid Hydrocarbon Yield Pounds/Hr, | | 800 | (Highly aromatic type oil containing some carbonaceous solids) |
| (22) Ash plus Water Pounds/Hr, | | 800 | (About 25% by weight ash, contains some residual carbonaceous solids) |

| Operating Conditions | Typical Specific Conditions | Broad Ranges |
|---|---|---|
| (7) Retort (Coker) | | |
| Pressure, atmospheres, | 5 | 1 to 500 |
| Temperature, °F., | 1000 | 800 to 1400 |
| (13) Grinder-Reactor | | |
| Pressure, atmospheres, | 10 | 1 to 500 |
| Temperature, °F., | 700 | 550 to 950 |
| (16) Conventional Liquid Vapor Separation | | |
| Pressure, psia., | 18 | 14.7 to 25 |
| Temperature, °F., | 90 | 40 to 120 |

The above-calculated example is idealized to simplify the presentation of an illustrative example. It is realized in a plant operation that other materials may be present and/or produced which may require various other removal steps, not illustrated, since such steps are not part of my inventive concept.

The disclosure, including data, has illustrated the value and effectiveness of my invention. The examples, the knowledge and background of the field of the invention and the general principles of chemistry and of other applicable sciences have formed the bases from which the broad descriptions of my invention including the ranges of conditions and the generic groups of operant components have been developed, and formed the bases for my claims here appended.

I claim:

1. A process for the beneficiation of a low grade particulate carbonaceous fuel source which comprises:

retorting in a solids/vapor first retort reactor means a first portion of said particulate carbonaceous fuel source under elevated temperatures with a fuel gas comprising hydrogen and CO, thereby producing products comprising a residue char, a first stream of off-gases comprising first gaseous hydrocarbons, and a first oil, and contacting in a second retort reactor means a second portion of said particulate carbonaceous fuel source with said oil under reaction conditions of elevated temperatures with CO and $H_2$ effective to convert at least in part said second portion of said particulate carbonaceous fuel source to products comprising further oil, hydrocarbon gases, CO, water, ash, and particulate carbon.

2. A process for the conversion of low grade solid carbonaceous material to higher quality fuels, which comprises:

(a) grinding a first portion of said low grade solid carbonaceous material in a first grinder means to produce a ground particulate low grade carbonaceous material, (b) retorting in a solids/vapor first retort reactor means said ground particulate carbonaceous material with a fuel gas comprising carbon monoxide and hydrogen at elevated temperature to produce a residue stream of char, and a first off-stream comprising water, hydrocarbon gases, and oils, (c) reacting said char with steam to produce a conversion gas stream comprising carbon monoxide and hydrogen, and a residue ash, (d) contacting in a second retort reactor means a second portion of said ground particulate carbonaceous material at elevated temperatures with at least a portion of said conversion gas from said step (b) and with at least a portion of said first off-stream from said retorting step (b), wherein said second retort means is a grinder-reactor solids/-liquid/gas reactor means, thereby producing a conversion stream comprising water, particulate carbon, ash, gases comprising CO, hydrogen, and hydrocarbons comprising hydrocarbon gases and further oil, (e) separating said conversion stream to obtain said hydrocarbon further oil and said particulate carbon as products, a second off-gas stream, and a waste stream comprising said water and ash.

3. The process according to claim 2 wherein said second off-gas stream is recycled at least in part to said retorting step.

4. The process according to claim 3 wherein said second off-gas stream is treated at least in part for carbon monoxide removal, thereby producing an enhanced hydrogen-containing gas stream, and wherein said hydrogen enhanced stream is employed in said contacting step (d).

5. The process according to claim 1 or 2 wherein said contacting step is conducted at a temperature in the range of about 550°–950° F., at pressures in the range of about 1–500 atmos.

6. The process according to claim 1 or 2 wherein said first retorting step is conducted at a temperature in the range of about 800°–1400° F., at a pressure in the range of about 1 to 500 atmos; and said second retorting step is conducted at a temperature in the range of about 550° to 950° F., at pressures in the range of about 1 to 500 atmos.

7. The process according to claim 2 further recycling at least in part said off-gas stream from said char/steam gasification step (c) to said retorting step (b) as at least a part of said fuel gas.

8. The process according to claim 7 further employing air in said char/steam gasification step (c).

9. The process according to claim 1 or 2 wherein said low grade carbonaceous material is a lignite, peat, or brown coal.

10. The process according to claim 9 wherein said low grade carbonaceous material is a lignite.

11. A process for conversion of particulate lignite to liquid and gaseous hydrocarbons which comprises:

(a) retorting in a first retort solids/vapor reactor means at elevated temperatures in contact with a fuel gas comprising carbon monoxide and hydrogen a first portion of said particulate lignite to produce char and a first off-stream comprising hydrocarbon gases and oils, (b) reacting in a gasifier means said char with steam, optionally further with air, to produce a second gas stream comprising carbon monoxide and hydrogen, and a residue ash, (c) contacting a second portion of said particulate lignite in a second retort means comprising a solids/liquid/vapor reactor means with at least a portion of said first off-stream and at least a portion of said CO and $H_2$ from said second gas stream, at elevated temperatures, thereby producing an effluent stream comprising further hydrocarbon oils, particulate carbon, gases, ash, and water, (d) separating said effluent stream into streams of water and ash, hydrocarbon oil containing said carbon particles as product, and a third gas stream comprising light hydrocarbons and CO, (e) recycling said third gas stream to at least one of said first retorting step (a), as at least a portion of said fuel gas therein and said contacting step (c), (f) recycling said second gas stream to at least one of said first retorting step (a) as at least a portion of said fuel gas therein and said contacting step (c).

12. The process of claims 1 or 2 wherein said further oil and said particulate carbon are admixed as a slurry fuel product.

13. The process according to claim 1 further employing in said contacting step at least a portion of said first gaseous hydrocarbons.

14. The process according to claim 11 further applying CO-removal to said third gas stream prior to recycling to said contacting step (c).

15. The process according to claim 11 further applying co-removal to said second gas stream prior to recycling to said contacting step (c).

* * * * *

UNITED STATES PATENT AND TRADEMARK OFFICE

CERTIFICATE OF CORRECTION

PATENT NO. : 4,435,269

DATED : March 6, 1984

INVENTOR(S) : Paul L. Gomory

It is certified that error appears in the above-identified patent and that said Letters Patent are hereby corrected as shown below:

Column 6, line 49, claim 3, line 3, after "step" should be

--- (b) as at least a part of said fuel gas ---.

Signed and Sealed this

*Seventeenth* Day of *July 1984*

[SEAL]

*Attest:*

GERALD J. MOSSINGHOFF

*Attesting Officer*

*Commissioner of Patents and Trademarks*